US008752918B2

(12) United States Patent
Kang

(10) Patent No.: US 8,752,918 B2
(45) Date of Patent: Jun. 17, 2014

(54) REFRIGERATOR WITH INNER DOOR

(75) Inventor: Sang Hun Kang, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 13/558,454

(22) Filed: Jul. 26, 2012

(65) Prior Publication Data

US 2013/0033163 A1 Feb. 7, 2013

(30) Foreign Application Priority Data

Aug. 5, 2011 (KR) ..... 10-2011-0078363
Aug. 5, 2011 (KR) ..... 10-2011-0078364
Aug. 5, 2011 (KR) ..... 10-2011-0078365
Aug. 5, 2011 (KR) ..... 10-2011-0078366

(51) Int. Cl.
*A47B 96/04* (2006.01)

(52) U.S. Cl.
USPC ..... 312/405.1

(58) Field of Classification Search
USPC ..... 312/321.5, 403–405.1, 116, 401; 62/448, 449
See application file for complete search history.

(56) References Cited

U.S. PATENT DOCUMENTS 1,275,511 A 8/1918 Welch
1,927,398 A 9/1933 Glasser
2,046,909 A 7/1936 Terry et al.
2,051,132 A 8/1936 Dart
2,095,811 A 10/1937 Goulooze
2,112,771 A 3/1938 Goulooze
2,129,923 A 9/1938 Mortimer
2,130,617 A 9/1938 Dockham
2,131,680 A 9/1938 Zahodiakin
2,135,878 A 11/1938 Sekyra
2,150,064 A 3/1939 Robert
2,213,274 A 9/1940 Flamm
2,276,937 A 3/1942 Arturo
2,653,851 A 9/1953 Davidson (Continued)

FOREIGN PATENT DOCUMENTS

CN 1627016 A 6/2005
EP 0 539 558 A1 5/1993

(Continued)

OTHER PUBLICATIONS

PCT International Search Report and Written Opinion dated Jan. 3, 2013 for Application No. PCT/KR2012/005763, 9 pages.

(Continued)

*Primary Examiner* — Matthew Ing
(74) *Attorney, Agent, or Firm* — Fish & Richardson P.C.

(57) ABSTRACT

A refrigerator includes a cabinet having at least one storage chamber, upper and lower hinges disposed at the cabinet, an inner door coupled to the upper and lower hinges to selectively open or close the storage chamber, an outer door disposed at the front of the inner door to selectively open or close an inner space of the inner door, a basket installation unit mounted onto an inner wall of the inner door, an inner door cover able to be inwardly open or closed based on a longitudinal rotational shaft disposed at the basket installation unit, a latch device to fix the inner door cover to the basket installation unit, and an opening member disposed at one side of the basket installation unit to rotate the inner door cover when the latch device is released.

9 Claims, 14 Drawing Sheets

(56) References Cited

U.S. PATENT DOCUMENTS

| | | | | |
|---|---|---|---|---|
| 2,692,813 | A | 10/1954 | Toronto | |
| 3,140,134 | A | 7/1964 | Nairn | |
| 3,218,111 | A | 11/1965 | Steiner | |
| 3,389,424 | A | 6/1968 | Fellwock | |
| 3,510,986 | A | 5/1970 | Berkowitz | |
| 3,836,221 | A | 9/1974 | Whistler | |
| 4,087,140 | A | 5/1978 | Linstromberg | |
| 4,302,907 | A | 12/1981 | Canals et al. | |
| 4,368,622 | A | 1/1983 | Brooks | |
| 4,514,021 | A | 4/1985 | Sundermeier et al. | |
| 5,111,618 | A | 5/1992 | Kaspar | |
| 5,209,082 | A | 5/1993 | Ha | |
| RE35,120 | E | 12/1995 | Heaney | |
| 5,584,902 | A | 12/1996 | Hartig | |
| 5,966,963 | A | 10/1999 | Kovalaske | |
| 6,055,823 | A | 5/2000 | Baker et al. | |
| 6,085,542 | A * | 7/2000 | Johnson et al. | 62/441 |
| 6,268,594 | B1 | 7/2001 | Leutner et al. | |
| 6,375,291 | B1 | 4/2002 | Nam et al. | |
| 6,722,142 | B1 | 4/2004 | Pagel | |
| 6,997,526 | B2 * | 2/2006 | Leimkuehler et al. | 312/321.5 |
| 7,008,032 | B2 | 3/2006 | Chekal | |
| 7,059,693 | B2 * | 6/2006 | Park | 312/405.1 |
| 7,081,318 | B2 * | 7/2006 | Lee et al. | 429/97 |
| 7,360,374 | B2 | 4/2008 | LaRose | |
| 2004/0137235 | A1 | 7/2004 | Paul | |
| 2005/0188506 | A1 | 9/2005 | Lee et al. | |
| 2005/0258724 | A1 | 11/2005 | Hwa | |
| 2006/0005484 | A1 | 1/2006 | Riblier et al. | |
| 2006/0265979 | A1 | 11/2006 | Cording | |
| 2007/0018548 | A1 | 1/2007 | Ertz et al. | |
| 2008/0006042 | A1 | 1/2008 | Lee | |
| 2009/0075069 | A1 | 3/2009 | Myli | |
| 2009/0272136 | A1 | 11/2009 | Knoell | |
| 2010/0107679 | A1 | 5/2010 | Park | |
| 2010/0170279 | A1 * | 7/2010 | Aoki | 62/264 |
| 2010/0307188 | A1 * | 12/2010 | Kwon et al. | 62/441 |
| 2010/0308705 | A1 | 12/2010 | Kwon | |
| 2011/0023510 | A1 | 2/2011 | Lee | |

FOREIGN PATENT DOCUMENTS

| | | | |
|---|---|---|---|
| JP | 1981-164495 | U | 12/1981 |
| JP | 1988-142682 | U | 9/1988 |
| JP | 06-066473 | A | 3/1994 |
| JP | 10-009757 | A | 1/1998 |
| JP | 2000-065459 | A | 3/2000 |
| JP | 2001-108357 | A | 4/2001 |
| JP | 2002-323287 | A | 11/2002 |
| JP | 2006-038437 | A | 2/2006 |
| JP | 2008-020104 | A | 1/2008 |
| JP | 2009-103395 | A | 5/2009 |
| KR | 1990-0008203 | Y1 | 9/1990 |
| KR | 1996-0011364 KR | | 4/1996 |
| KR | 1999-037440 | A | 5/1999 |
| KR | 10-0200894 | B1 | 6/1999 |
| KR | 1999-042339 | A | 6/1999 |
| KR | 1999-062159 | A | 7/1999 |
| KR | 10-1999-0069240 | A | 9/1999 |
| KR | 20-1999-0039593 | U | 11/1999 |
| KR | 1999-039593 | A | 11/1999 |
| KR | 20-0164322 | Y1 | 2/2000 |
| KR | 20-0168373 | Y1 | 2/2000 |
| KR | 10-2000-0053871 | A | 9/2000 |
| KR | 20-204129 | Y1 | 12/2000 |
| KR | 20-0314145 | Y1 | 11/2001 |
| KR | 2002-0006200 | A | 1/2002 |
| KR | 2002-083115 | A | 11/2002 |
| KR | 10-0376167 | B1 | 3/2003 |
| KR | 10-2003-0083812 | A | 11/2003 |
| KR | 2003-0083813 | A | 11/2003 |
| KR | 2005-0111094 | A | 11/2005 |
| KR | 10-0596533 | B1 | 7/2006 |
| KR | 2006-0106342 | A | 10/2006 |
| KR | 2007-0008910 | A | 1/2007 |
| KR | 10-0733309 | B1 | 6/2007 |
| KR | 10-0887575 | B1 | 3/2009 |
| KR | 2009-0077564 | A | 7/2009 |
| KR | 10-2010-0061492 | A | 6/2010 |
| KR | 2010-0095954 | A | 9/2010 |
| KR | 2011-0041658 | A | 4/2011 |
| WO | WO 2010/016629 | A1 | 2/2010 |
| WO | WO 2011/081279 | A1 | 7/2011 |

OTHER PUBLICATIONS

U.S. Office Action dated Mar. 29, 2013 for U.S. Appl. No. 13/391,632, 10 pages.

U.S. Office Action dated Jul. 1, 2013 for U.S. Appl. No. 13/390,946, 24 pages.

Korean Notice of Allowance dated Oct. 24, 2013 for Application No. 10-2011-0078366, in English, 5 pages.

Korean Office Action dated Sep. 9, 2013 for Application No. 10-2011-0078363, in English, 4 pages.

Korean Notice of Allowance dated Dec. 19, 2013 for Application No. 10-2011-0078364, 2 pages.

* cited by examiner

REFRIGERATOR WITH INNER DOOR

CROSS-REFERENCE TO RELATED APPLICATION

The present disclosure relates to subject matters contained in priority Korean Application Nos. 10-2011-0078363, 10-2011-0078364, 10-2011-0078365, 10-2011-0078366, filed on Aug. 5, 2011, which are herein expressly incorporated by reference in their entireties.

BACKGROUND OF THE INVENTION

1. Field of the Invention

This specification relates to a refrigerator with an inner door, and particularly, to a refrigerator with an inner door inside a door.

2. Background of the Invention

A refrigerator is an apparatus for keeping foods or the like for a long-term of time with maintaining storage chambers, such as a refrigerating chamber or a freezing chamber defined within a cabinet, in a predetermined temperature range. Depending on configurations, refrigerators may be divided into various types, such as a side-by-side refrigerator, a bottom freezer type refrigerator and the like. In addition, for user convenience, a refrigerator equipped with a dispenser or a so-called home bar, which allows a user to take drinks or seasoning without opening a refrigerating chamber door, is produced.

The home bar includes a home bar case located inside the refrigerating chamber door, and a home bar door to open or close a front opening of the home bar case. Here, the home bar door is disposed at the front surface of the refrigerating chamber door to allow a user to approach the inside of the refrigerating chamber by opening only the home bar door. In some cases, an inner door cover for opening or closing the inside of the refrigerating chamber within the home bar case may further be disposed. That is, the front and rear surfaces of the home bar case are all open, and accordingly the home bar door and the inner door cover for opening or closing such openings may be individually disposed.

In the related art, the inner door cover is coupled to the home bar case to be slidable in a vertical direction or coupled to the home bar door by hinges to be rotatable in the vertical direction. Accordingly, in order to take out foods or the like stored in the home bar or bring such foods or the like in the home bar for storage by opening the inner door cover, the inner door should be held with one hand to prevent it from being slid or rotated down, which causes inconvenience in use.

To overcome such inconvenience, the inner door cover may be maintained in an open state. However, in this case, if the refrigerating chamber door is closed in the open state of the inner door cover due to a user's mistake or other reasons, the inner door cover may interfere with other components such as a shelf, thereby being in danger of damage. Especially, for a French-type refrigerator, a cold air leakage preventing member for sealing between two refrigerating chamber doors is disposed in the front surface of the refrigerating chamber. Hence, interference between the inner door cover and the cold air leakage preventing member should be avoided.

Also, the inner cover door is made of a transparent material to facilitate recognition of foods or the like stored inside. However, the transparent material has a low strength as compared with an opaque material. Accordingly, when the inner cover door is fabricated larger than expected, it may be easily destroyed.

SUMMARY OF THE INVENTION

Therefore, to address those problems of the related art, an aspect of the detailed description is to provide a refrigerator having an inner door cover capable of easily opening a home bar door and also being free from an interference with other components disposed within a refrigerating chamber.

To achieve these and other advantages and in accordance with the purpose of this specification, as embodied and broadly described herein, there is provided a refrigerator including a cabinet having at least one storage chamber, upper and lower hinges disposed at the cabinet, an inner door coupled to the upper and lower hinges to selectively open or close the storage chamber, an outer door disposed at the front of the inner door to selectively open or close an inner space of the inner door, a basket installation unit mounted onto an inner wall of the inner door, an inner door cover able to be inwardly open or closed based on a longitudinal rotational shaft disposed at the basket installation unit, a latch device to fix the inner door cover to the basket installation unit, and an opening member disposed at one side of the basket installation unit to rotate the inner door cover when the latch device is released.

In accordance with the aspect, the inner door cover, which opens or closes the inner door providing an additional space for storing products, may be coupled to the inner door by the longitudinal rotational shaft, such that the inner door cover can remain open. Also, when the inner door cover is open, the inner door cover may be rotated by the opening member, accordingly, the inner door cover can be fixed to an appropriate position after release of the latch device, which results in improvement of convenience in use.

That is, the opening member may include an elastic member disposed in the longitudinal rotational shaft, which allows the inner door cover to be fixed to a desired position. In other words, the inner door cover may be located within a predetermined range defined by first and second angles, thereby improving the convenience in use. The first angle may be defined as an angle as enough as a user can put a hand in a gap between the inner door cover and the inner door. The second angle may be defined as an angle capable of avoiding interference with another refrigerating chamber door as in a French type refrigerator even if the inner door is open toward the cabinet with the inner door cover open.

The opening member may include a buffer disposed at the basket installation unit. The buffer may function to absorb vibration and noise and simultaneously apply a force to the door in a direction of the door being open upon release of the latch device.

In accordance with the aspect, the cabinet may include a refrigerating chamber and a freezing chamber, which may be located at upper and lower sides of the cabinet, respectively, or vice versa. Also, a separate storage chamber may further be disposed between the refrigerating chamber and the freezing chamber.

Here, the elastic member may apply an elastic force in a direction of opening the inner door cover when the inner door cover is open below the first angle. Consequently, upon release of the latch device, the inner door cover may be automatically open to a position over the first angle by virtue of the elastic member. Therefore, only the release of the latch device may result in creating a space as wide as a user's hand approaches the inside of the inner door.

The elastic member may apply an elastic force in a direction of closing the inner door cover when the inner door cover is open over the second angle. Accordingly, even if the inner door is closed, due to a user's mistake, with the inner door cover open, it may be possible to prevent the damage of the refrigerating chamber, which may be caused due to the interference with the second refrigerating door.

In the meantime, the latch device may be disposed at the inner door, and a hook engaged with the latch device may be disposed at the inner door cover. Here, the inner door cover may include a support portion where the latch device is installed and cover portions installed at upper and lower sides of the support portion, respectively.

That is, the inner door cover may be configured by a plurality of panels other than a single panel, thereby facilitating its fabrication. That is, when the inner door cover is fabricated to have an almost similar length to inner door, it is difficult to reduce deficiencies such as bending or torsion during injection molding, accordingly, productivity may not be ensured. However, upon using the plurality of panels, the probability of causing a defect may be relatively lowered.

Especially, when the support portion is made of an opaque material and the cover portion is made of a transparent material, the opaque material having a relatively high strength can improve the rigidity of the inner door cover and the transparent material can facilitate recognition of products stored inside. In addition, the latch device can be installed at the opaque support portion, so as to be coupled to the inner door cover more firmly.

In the meantime, the inner door comprises a buffer contacting the inner door cover. Here, the buffer may be disposed to contact an upper corner portion of the inner door cover. Also, the inner door cover may be curved in an arcuate shape when viewed from a side surface, such that the buffer can surely contact the inner door cover even if the change in the shape of the inner door cover is generated during use or fabrication.

In addition, a basket installation unit installed at a rear surface of the inner door may further be provided. The basket installation unit may include a pair of side walls facing each other, and upper and lower surfaces to connect both ends of the respectively side walls. The basket installation unit may provide a storage space together with the inner door so as to store products therein, accordingly, its capacity can be increased as compared with forming the storage space only in the inner door.

Here, at least part of the side wall of the basket installation portion may be made of a transparent material, which facilitates recognition of products without completely opening the inner door.

At least one through hole may be formed through the side walls or upper and lower surfaces of the basket installation unit. The through hole may function as a path for allowing circulating of cold air between the refrigerating chamber and the storage space defined in the inner door.

The inner door cover may also include at least one cold air circulation hole.

In accordance with another aspect of the detailed description, there is provided a refrigerator including a storage chamber formed in a refrigerator cabinet, upper and lower hinges mounted onto upper and lower walls of the cabinet, an inner door coupled to the upper and lower hinges to selectively open or close the storage chamber, a basket installation unit mounted onto an inner wall of the inner door, an inner door cover able to be inwardly open or closed based on a longitudinal rotational shaft disposed at the basket installation unit, a latch device to fix the inner door cover to the basket installation unit, and an elastic member mounted onto one side of the basket installation unit to apply a rotational force to the inner door cover.

In accordance with the aspects, the inner door cover can be easily open or closed to improve convenience in use. The elastic member may allow the inner door cover to remain at a position free from interference, whereby the inner door cover can be prevented from being damaged due to user's carelessness.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of a refrigerator in accordance with the exemplary embodiments, with reference to the accompanying drawings. For the sake of brief description with reference to the drawings, the same or equivalent components will be provided with the same reference numbers, and description thereof will not be repeated.

Figure 1:
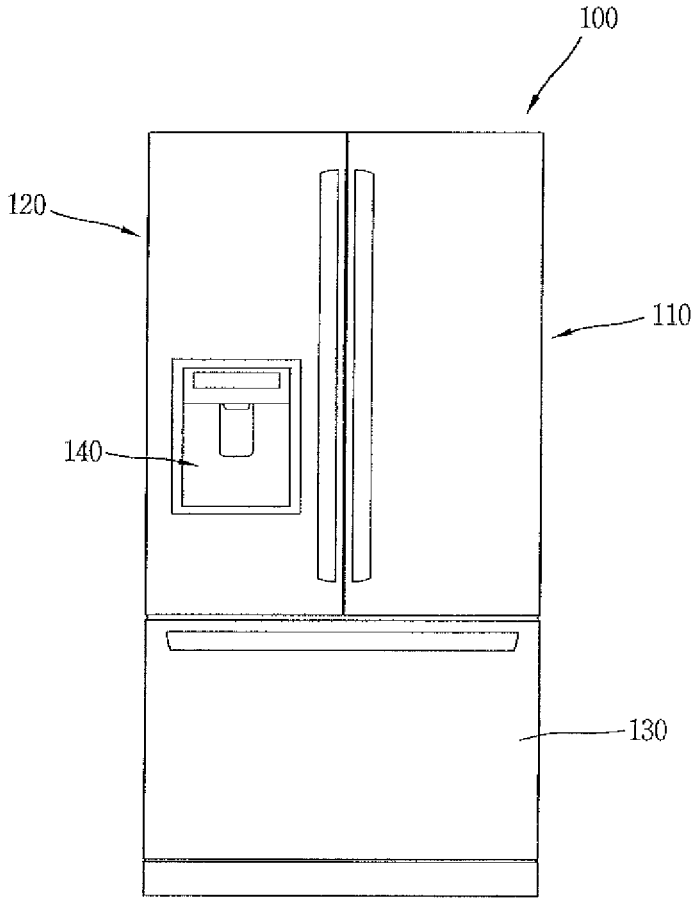
FIG. 1 is a perspective view showing a first exemplary embodiment of a refrigerator.
Figure 2:
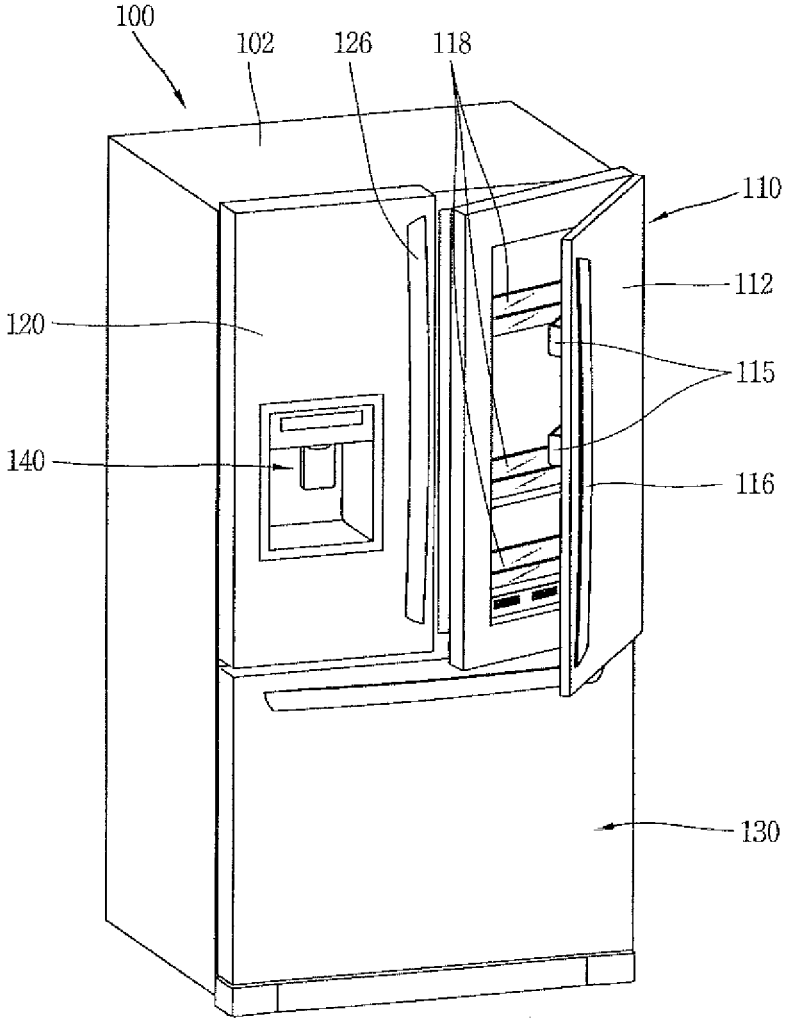
FIG. 2 is a perspective view showing open states of an inner door cover and an inner door in the first exemplary embodiment shown in FIG. 1.
Figure 3:
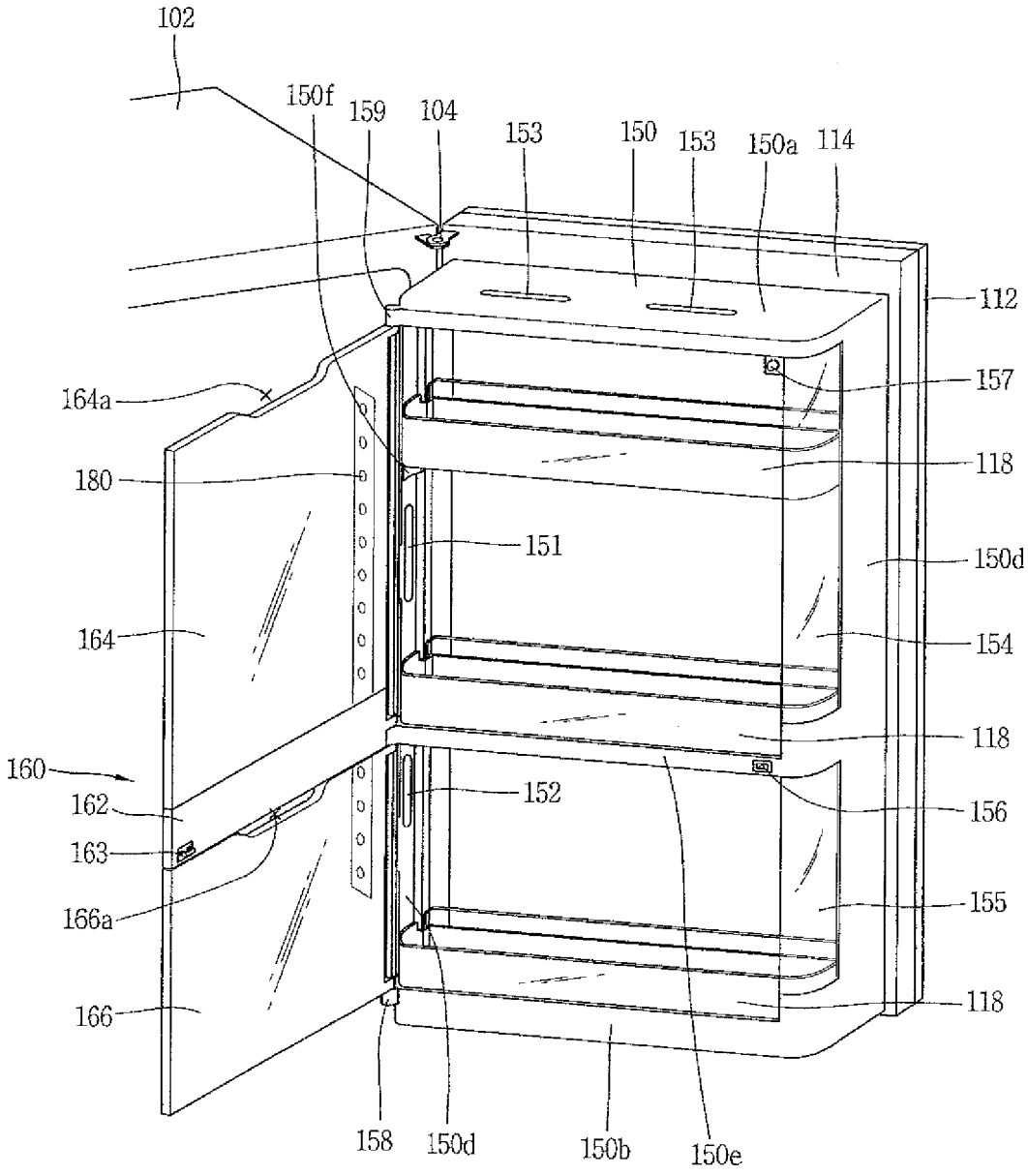
FIG. 3 is an enlarged perspective view showing a first refrigerating chamber door and its adjacent potion in the first exemplary embodiment shown in FIG. 1.
Figure 4:
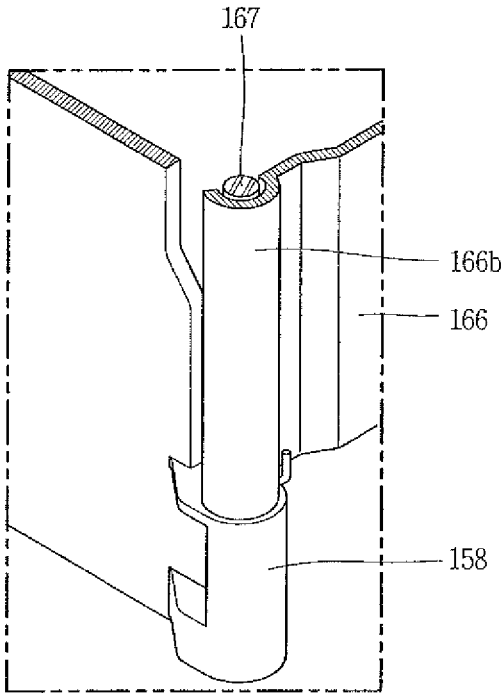
FIG. 4 is an enlarged perspective view showing one end portion of a hinge shaft and its adjacent potion shown in FIG. 3.
Figure 5:
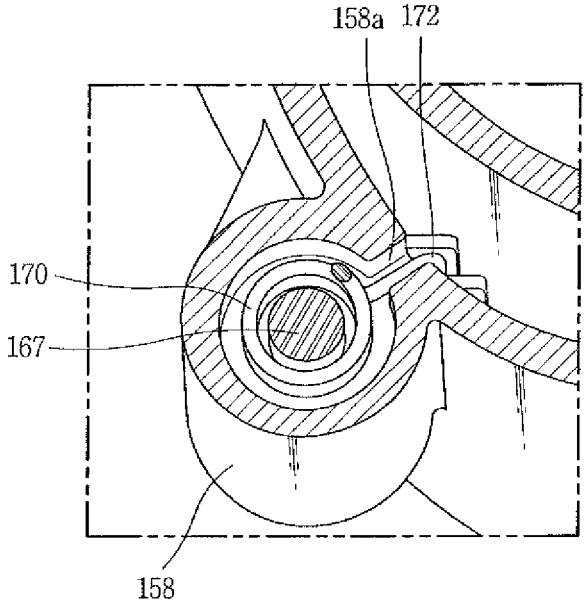
FIG. 5 is a cut view of one end of the hinge shaft shown in FIG. 4.

FIG. 1 is a perspective view showing a first exemplary embodiment of a refrigerator, FIG. 2 is a perspective view showing open states of an inner door cover and an inner door in the first exemplary embodiment shown in FIG. 1, FIG. 3 is an enlarged perspective view showing a first refrigerating chamber door and its adjacent potion in the first exemplary embodiment shown in FIG. 1, FIG. 4 is an enlarged perspective view showing one end portion of a hinge shaft and its adjacent potion shown in FIG. 3, and FIG. 5 is a cut view of one end of the hinge shaft shown in FIG. 4.

Referring to FIG. 1, a refrigerator 100 according to a first exemplary embodiment may include a refrigerating chamber and a freezing chamber located at upper and lower sides, respectively, first and second doors 110 and 120 to open or close the refrigerating chamber, and a freezing chamber door 130 to open or close the freezing chamber. Each of the first and second doors 110 and 120 may allowed for opening or closing a half of the single refrigerating chamber. Hence, a user can open a part, not all, of the refrigerating chamber for taking out stored foods or the like or put in such foods or the like in, so, this structure is advantageous in view of preventing cold air from flowing outside. However, the present disclosure may not be limited to the structure, but applicable even to a so-called 'side-by-side refrigerator' having a freezing chamber and a refrigerating chamber side by side in a vertical direction of a refrigerator main body.

The first and second refrigerating chamber doors 110 and 120 may be mounted by hinges 104 such that one end portions thereof can be rotatable with respect to a cabinet 102. The freezing chamber door 130 is implemented in a drawer type door in the exemplary embodiment. Alternatively, the freezing chamber door may be configured to be open or closed in a rotating manner like the refrigerating chamber doors. That is, the freezing chamber door 130 may have a basket form which is pulled out toward a user or pushed in from the user.

The front surface of the second refrigerating chamber door 120 is shown having a handle 126, and a dispenser 140 for providing water or ice. Detailed description of the dispenser 140 will be omitted.

Referring to FIG. 2, the first refrigerating chamber door 110 may include an outer door 112 having a handle 116 outside thereof, and an inner door 114 located between the outer door 112 and the refrigerating chamber. Both the outer door 112 and the inner door 114 may be rotatably coupled to the cabinet 102 by hinges. Therefore, a user can individually rotate the outer door 112 and the inner door 114. As one example, only the outer door 112 may be open or closed with the inner door 114 contacting the front surface of the cabinet 102, namely, with the inner door 114 closed. Thus, the outer door 112 may function as a door to open or close the related art home bar. However, in the exemplary embodiment, the area of the outer door 112 is the same as the area of the second refrigerating door 120, so it appears that there is no home bar. Consequently, the outer door 112 can have a simple outer appearance as well as functioning as a home bar door.

A plurality of baskets 115 may be provided on an inner surface of the outer door 112. A plurality of baskets 118 which are detachable may also be provided inside the inner door 114. The inner door 114 may have an approximately rectangular shape. The inner door 114 may also have front and rear surfaces open, thereby having a shape like a rectangular frame. Referring to FIG. 3, a basket installation unit 150 may be mounted onto an inner surface of the inner door 114, thereby extending a storage space for keeping products into the refrigerating chamber.

The basket installation unit 150 may also have an approximately rectangular shape, and include upper and lower surfaces 150*a* and 150*b* facing each other and side walls 150*c* and 150*d* facing each other. The upper and lower surfaces 150*a* and 150*b* and the side walls 150*c* and 150*d* may extend from the inner door 114 into the refrigerating chamber, thereby increasing a storage space inside the inner door 114.

Meanwhile, the basket installation unit 150 may be partitioned into two spaces by a barrier 150*e*. Through holes 151 and 152 may be formed respectively through the side walls 150*d* partitioned by the barrier 150*e*. The through holes 151 and 152 may face the inner wall of the refrigerating chamber with being spaced therefrom when the inner door 114 and the refrigerating chamber door are closed. Accordingly, the through holes 151 and 152 may act as paths through which cold air within the refrigerating chamber is introduced or discharged. In addition, a light emitting diode (LED) lamps 180 may be installed at the inner wall of the refrigerating chamber. The LED lamps 180 may be turned on when only the first refrigerating chamber door is open with the inner door closed, or both the inner door and the refrigerating chamber door are open.

In particular, when only the first refrigerating chamber door is open with the inner door 114 closed, the through holes 151 and 152 may allow for introduction of light emitted from the LED lamps 180 into the inner door 114. Accordingly, products such as foods or the like stored inside the inner door 114 can easily be recognized at night even through separate lamps are not installed at the inner door. Also, since the through holes 151 and 152 are located at a side surface of an inner door cover made of a transparent material, the inner door 114 cover may act as a light guide film for guiding emitted light. Hence, the LED lamps 180 are located at the side surface of the inner door but can uniformly light up the inside of the inner door 114.

A pair of cold air circulation holes 153 may be formed through the upper surface 150*a* of the inner door 114. The cold air circulation holes 153, similar to the aforementioned through holes, may be spaced apart from the inner wall of the refrigerator so as to act as paths through which cold air can circulate. Here, the LED lamps are located at the side wall of the refrigerating chamber in the exemplary embodiment, but they may be located at an upper portion on the inner wall of the refrigerating chamber. In this structure, the cold air circulation holes 153 may act as paths through which light emitted from the LED lamps 180 is introduced into the inner door 114. The LED lamps 180 may not be limited to a lighting element including the LED, but include any device capable of emitting light.

Transparent (light-transmittable) windows 154 and 155 may be installed at upper and lower sides of the barrier 150*e*. The transparent windows 154 and 155 may start from the side wall and extend to an inner surface of the basket installation unit 150 to have a curved section. The transparent windows 154 and 155 may allow products stored inside to be recognized from the side surface of the inner door 114. Also, the transparent windows 154 and 155 are located at positions facing the through holes 151 and 152, so as to evenly diffuse light of the LED lamps 180.

A latch fixing member 156 may be mounted to one side of the barrier 150*e*. The latch fixing member 156 may be engaged with a latch, which is disposed at an inner door cover 160 to be explained later, to fix the inner door cover 160. A buffer 157 may be installed at one corner of the inner door 114 to buffer an impact, which may be caused during opening or closing of the inner door cover 160, and prevent vibration or noise, which is generated from the inner door cover 160 due to vibration, which may be generated during operation of the refrigerator.

The inner door cover 160 may be coupled to the inner door 114 by a hinge shaft 167, which is fixed to hinge fixing portions 158 and 159 installed at the inner door 114. The inner door cover 160 may include a support portion 162 and cover portions 164 and 166 coupled to upper and lower sides of the support portion 162, respectively. The support portion 162 may be made of an opaque synthetic resin having a relatively high strength, and the cover portions 164 and 166 may be made of a transparent or semi-transparent synthetic resin.

As such, as the support portion and the cover portions are configured to have different strengths without configuring the entire inner door cover as one panel, the strength and visibility can be simultaneously satisfied. That is, when entirely made of the transparent material, it may be preferable in view of visibility, but a problem of decreasing a life span of the inner door cover may be caused due to low hardness and high brittleness.

In the meantime, a latch 163 coupled to the latch fixing member 156 may be installed at the support portion 162. As the latch 163 is installed at the opaque support portion 162, the inner structure of the latch 163 can be obscured and thus an appearance of the inner door cover 160 can be maintained neat.

Cold air circulation holes 164*a* and 166*a* may be formed at upper sides of the respective cover portions 164 and 166. The cold air circulation holes 164*a* and 166*a* may allow cold air of the refrigerating chamber to be introduced into the inner door 114 in a closed state of the inner door cover 160. A hinge fixing portion 166*b* may be formed at a hinge-side end portion of the cover portion 166. The hinge fixing portion 166*b* may be in an arcuate form in which the hinge shaft 167 is inserted. Accordingly, the inner door cover 160 can be open or closed with rotating in a horizontal direction based on the hinge shaft 167 inserted in the hinge fixing portion 166*b*.

As such, since the rotating direction of the inner core cover 160 is allowed to be free from the gravity, the inner door cover 160 can be disposed at a random rotational angle. Therefore, when taking products out or putting product in the inner door, it is not needed to hold the inner door cover with one hand. Also, since the support portion made of the transparent material is employed and the latch is installed at the support portion, the inner door cover can be supported more stably.

Here, the inner door cover may interfere with the second refrigerating chamber door during opening or closing of the inner door, depending on a length or an open angle of the inner door cover. Especially, a cold air leakage preventing member for prevention of cold air leakage, which may be generated between the two refrigerating chamber doors, may be installed at an end portion of the second refrigerating chamber door. The cold air leakage preventing member may be installed at the front surface of the refrigerating chamber in the longitudinal direction, thereby causing high likelihood of occurrence of the interference with the inner door cover 160.

To address such problems, the hinge shaft 167 may be inserted into the hinge fixing portion 158 with interposing a coil spring 170 therebetween. The coil spring 170 may include a protrusion 172. One end (not shown) of the coil spring 170 may be coupled to the hinge shaft 167, and the other end protrusion 172 may be disposed in a recess 158*a* formed at the hinge fixing portion 158. The recess 158*a* may be formed wider than the protrusion 172 of the coil spring 170. Accordingly, an elastic force may be applied to the hinge shaft 167 only when the protrusion 172 contacts the inner wall of the recess 158*a*.

Therefore, the adjustment of the interval and position of the recess may allow adjusting of a range that elastic forces are applied to the hinge shaft and the inner door cover. In the exemplary embodiment, if it is assumed that the contact state between the inner door cover and the front surface of the basket installation unit is 0°, it may be set such that the elastic force of the coil spring is not applied to the hinge shaft and the inner door cover at an angle in the range of 30° to 100°. On the contrary, when the inner door cover is open below 30°, an elastic force may be applied such that the inner door cover can be open over 30°. When open over 100°, the elastic force may be applied such that the inner door cover can be open below 100°.

Here, the angle 30° is a minimum angle as enough as a user can put a hand in a gap between the basket installation unit and the inner door cover. The angle 100° is a maximum angle capable of avoiding the interference with the second refrigerating chamber door or the cold air leakage preventing member. Of course, those angles may differ according to the size of the refrigerator or the location of the door, and an appropriate value can be selected by a person skilled in the art.

Accordingly, when a user presses the latch toward the latch fixing member, the inner door cover is automatically open over 30° by the elastic force applied by the coil spring. In addition, upon being open over 100°, the inner door cover may be rotated by the coil spring to be open below 100°, thereby avoiding interference.

An end portion of the inner door cover may have a curved shape to have an arcuate shape when viewed from a side surface. Here, a portion of the inner door cover facing the buffer may be located closer to the inner door than a portion of the inner door cover where the latch is located. Hence, when the latch is coupled to the latch fixing member, the corner portion of the inner door cover may be strongly compressed onto the buffer, thereby effectively preventing the vibration of the inner door cover, which is generated due to vibration during operation of the refrigerator. In addition, even if a deviation is generated a bit during fabrication, the corner portion and the buffer may be allowed to be accurately compressed (closely adhered) onto each other.

Figure 6:
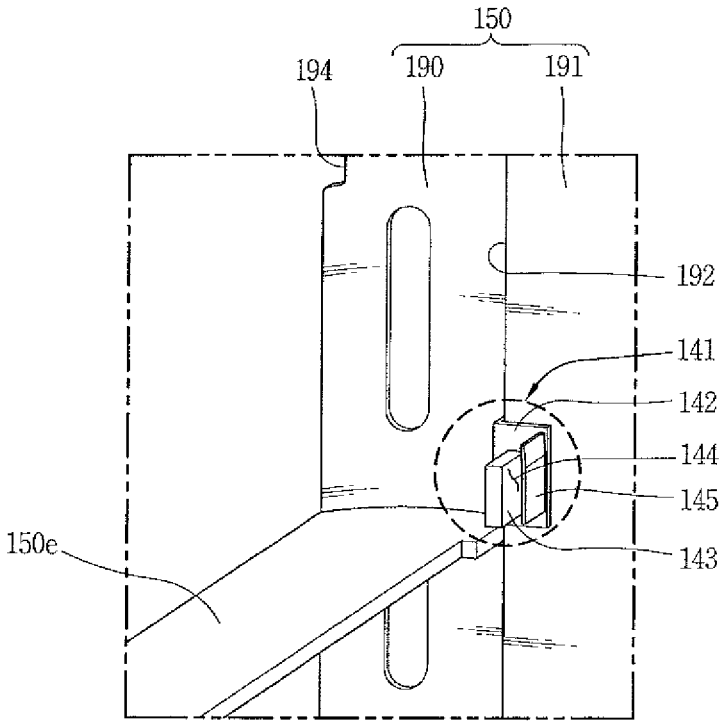
FIG. 6 is a perspective view showing brackets and basket coupling bodies installed at a basket installation unit in the first exemplary embodiment shown in FIG. 1.
Figure 7:
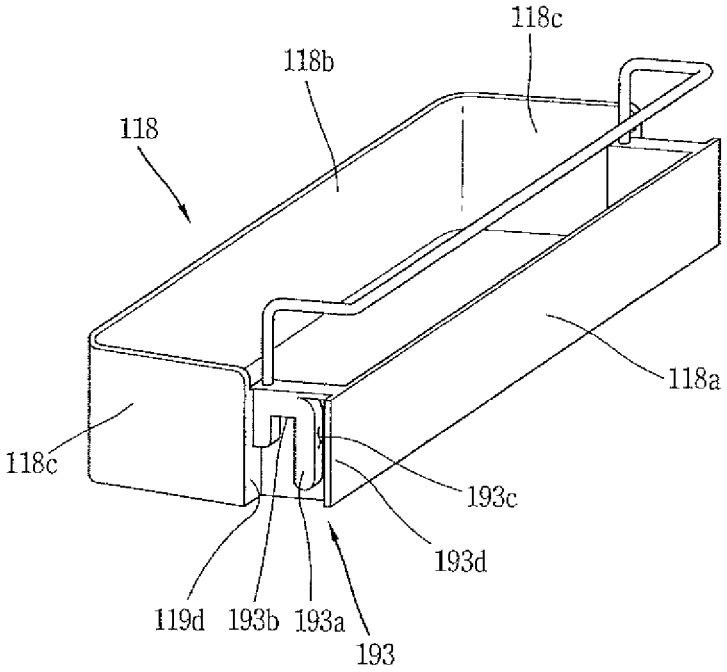
FIG. 7 is a perspective view of a door basket in the first exemplary embodiment shown in FIG. 1.
Figure 8:
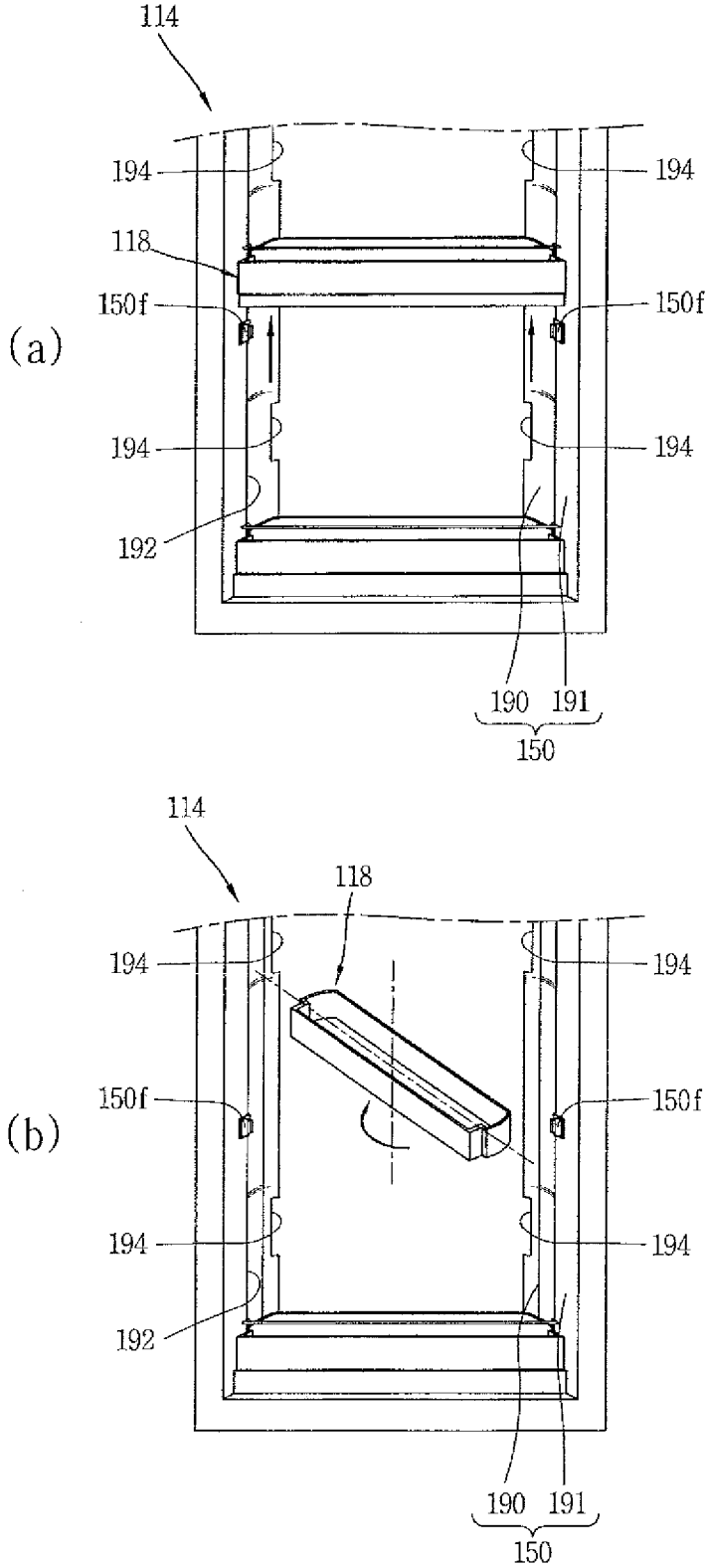
FIG. 8 is a perspective view showing a process of attaching or detaching the door basket in the first exemplary embodiment shown in FIG. 1.

Referring to FIGS. 6 to 8, the basket installation unit 150 may include an inner basket installation portion 190 and an outer basket installation portion 191, and a step jaw 192 protruding from the outer basket installation portion 191 between the inner basket installation portion 190 and the outer basket installation portion 191.

That is, referring to FIG. 6, the inner basket installation portion 190 is formed consecutively with the outer basket installation portion 191 with the step jaw 192 located therebetween, thereby defining a basket installation portion larger than the outer basket installation apportion 191. Also, the inner basket installation portion 190 may have a curvature to be curved inwardly. Hence, as the inner basket installation portion 190 has the curvature, the separation of the door basket 118 into the inner space of the refrigerator may be prevented and the basket 118 may be lifted up in parallel.

The step jaw 192 of the basket installation unit 150 may prevent the basket 118 from being separated out and simultaneously allow the basket 118 to be lifted up in parallel.

Regarding the basket 118 mounted at the inner door 114, referring to FIG. 3, a plurality of baskets 118 may be horizontally mounted onto the basket installation unit 150 of the inner door 114. FIG. 3 shows, but not limited to, total three baskets 118 mounted.

Among the baskets 118 mounted onto the basket installation portion 150, lower and central baskets may be supported by the lower surface 150*b* and the barrier 150*e*, respectively, and the uppermost basket may be supported by supporters 150*f* formed at each side wall 150*c* and 150*d*. The supporters 150*f* may protrude from each side wall 150*c* and 150*d*.

As some of the baskets are supported by the supporters protruding from the side walls, the central basket can be longer in length to allow for keeping long products upon removal of the uppermost basket.

Of course, only the barrier without the bracket may be provided, or vice versa.

Referring to FIG. 7, each of the baskets 118 may define a space for receiving products inside by including a front panel 118*a*, a rear panel 118*b* and left and right side panels 118*c*. Preferably, the left and right side panels 118*c* may be externally curved to have the same curvature as the inner basket installation portion 190. As the curvature of the side panel 118*c* and the curvature of the inner basket installation portion 190 may be approximately the same, the basket 118 can be slidable up and down after being mounted onto the basket installation portion 150.

The basket 118 may include step jaw locking portions 118*d* curved from the side panels 118*c* to be located at the step jaw 192 of the basket installation unit 150.

The basket 118 may be prevented from being separated to the rear surface (i.e., inside) by the curved curvature of the side panels 118*c* and the step jaw locking portion 118*d* is locked at the step jaw 192 of the basket installation unit 150, such that the basket 118 can be prevented from being separated to the front side (i.e., outside). Accordingly, the basket 118 can be lifted up by being slid along a vertical direction of the basket installation unit 150.

The inside of the basket installation unit 150 is shown having basket coupling bodies 141 coupled to the basket 118, and inner door coupling bodies 193 formed at both sides of the basket 118 and coupled to the basket coupling bodies 141.

As shown in FIGS. 6 and 7, the basket coupling bodies 141 may be installed at both ends of the barrier 150*e* inside the basket installation unit 150. The installed basket coupling bodies 141 may be vertically inserted into the inner door coupling bodies 193 of the basket 118, thereby allowing the basket 118 to be lifted up and restricting the basket 118 from being moved down or back and forth.

Referring to FIG. 6, each of the basket coupling bodies 141 may include a support plate 142, a protruded coupling member 143 and a coupling protrusion 145 both protruding from the support plate 142, and a coupling recess 144 formed between the protruded coupling member 143 and the coupling protrusion 145.

Still referring to FIG. 6, the basket coupling body 141 may preferably be formed at the outer basket installation portion 191 such that the inner door coupling body 193 of the basket 118 can be coupled to the outer basket installation portion 191 and the side panels 118*c* of the basket 118 can be vertically slidable with respect to the inner basket installation portion 190.

Also, referring to FIG. 7, the inner door coupling body 193 may include a stopping jaw 193*b* protruding in a direction of being locked at an upper surface of the protruded coupling member 143, and an insertion protrusion 193*a* protruding in a direction of being inserted into the coupling recess 144.

The inner door coupling body 193 may further include a support panel 193*d* to obscure the outside of the coupling protrusion 145 of the basket coupling body 141. The support panel 193*d* may be formed as a separated member so as to reinforce the coupling of the basket 118, or integrally extend from both ends of the front panel 118*a*.

The thusly-formed basket coupling body 141 and the inner door coupling body 193 may be coupled to each other in an inserting manner as the basket 118 is inserted in the basket installation portion 150 to be pushed from up to down. That is, in FIGS. 6 and 7, the coupling bodies 141 and 193 may be inserted in the corresponding positions. The insertion protrusion 193*a* is inserted into the coupling recess 144 and the coupling protrusion 145 may be inserted in a coupling protrusion insertion recess 193*c*. The inner door coupling body 193 of the basket 118 may be supported by the stopping jaw 193*b* at the upper surface of the protrusion coupling member 143 to be restricted from moving down. With the configuration, the basket 118 can be firmly coupled to the basket installation unit 150 of the inner door 114, so as to be restricted in a downward direction and all other directions, except for an upward lifting to detach the basket 118.

In the meantime, the first exemplary embodiment shows that the basket 118 should be lifted up and drawn to the front surface or the rear surface. However, the drawing to the front surface is impossible due to the step jaws 192 and the drawing to the rear surface is also impossible due to the transparent windows 154 and 155 and the like. Therefore, the basket lifted up should be drawn out after rotating based on a rotational shaft extending in the back and forth directions of the refrigerator. To this end, however, an air gap to some degree should be present between both ends of the basket and the side walls of the basket installation unit. The air gap may preferably be minimized because it reduces an available space within the refrigerator.

For the purpose, cut-off portions 194 may be formed at the transparent windows or the side walls. The cut-off portions 194 may allow for formation of spaces in which the basket 118 can rotate based on a rotational shaft in a longitudinal direction, accordingly, the basket 118 can be drawn out easily with the minimized air gap. Here, the cut-off portion 194 may be formed at both the transparent window and the side wall, or at one of them.

In order to selectively open or close the first refrigerating chamber door and the inner door, an exemplary structure with a coupling unit installed between the first refrigerating chamber door and the inner door may also be considered.

Figure 9:
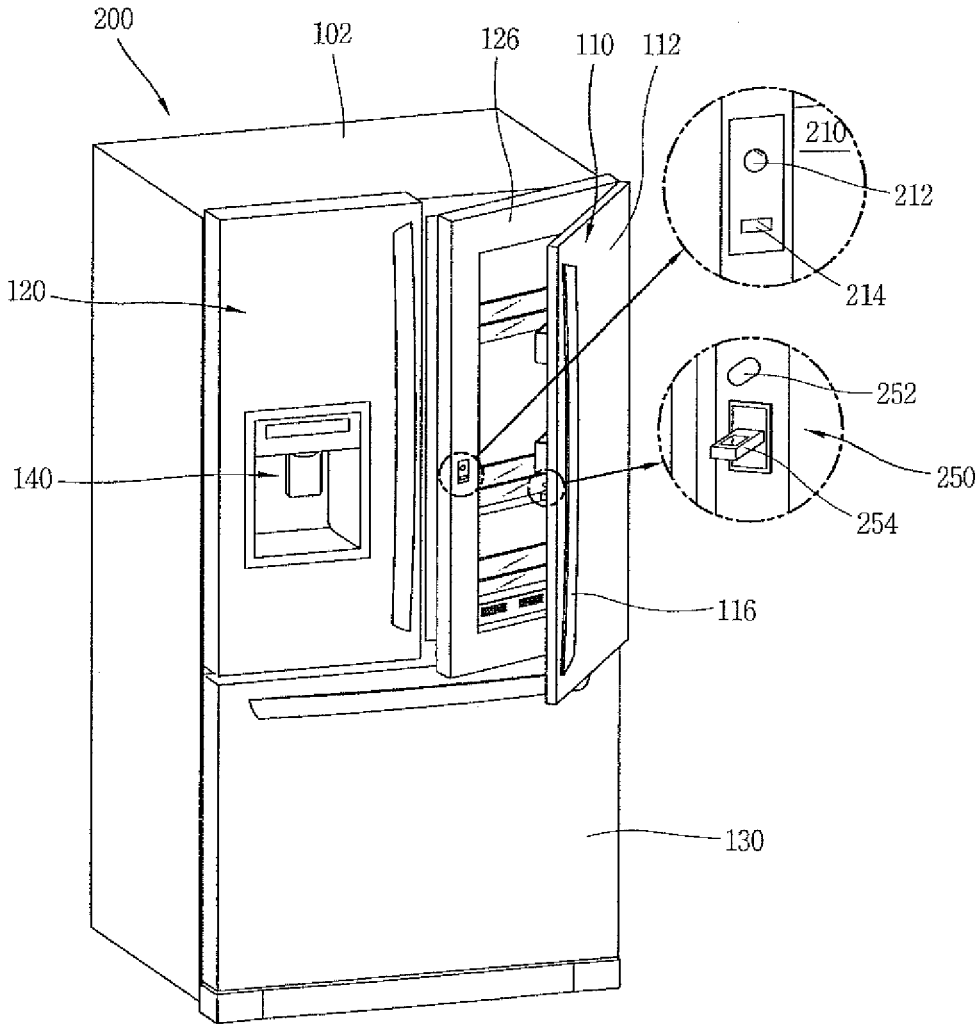
FIG. 9 is a perspective view showing a second exemplary embodiment of a refrigerator.
Figure 10:
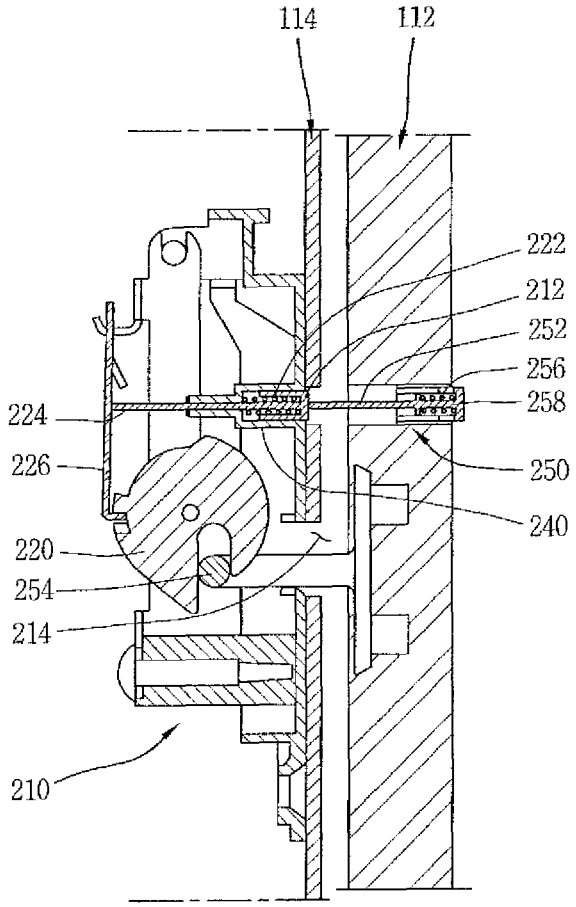
FIGS. 10 and 11 are sectional views showing a latch device in the second exemplary embodiment shown in FIG. 9.
Figure 11:
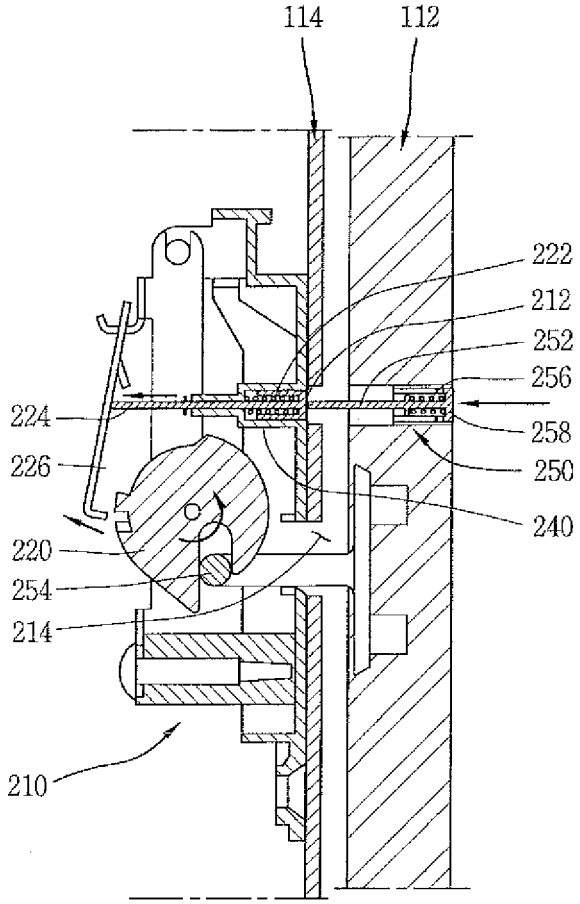
Figure 12:
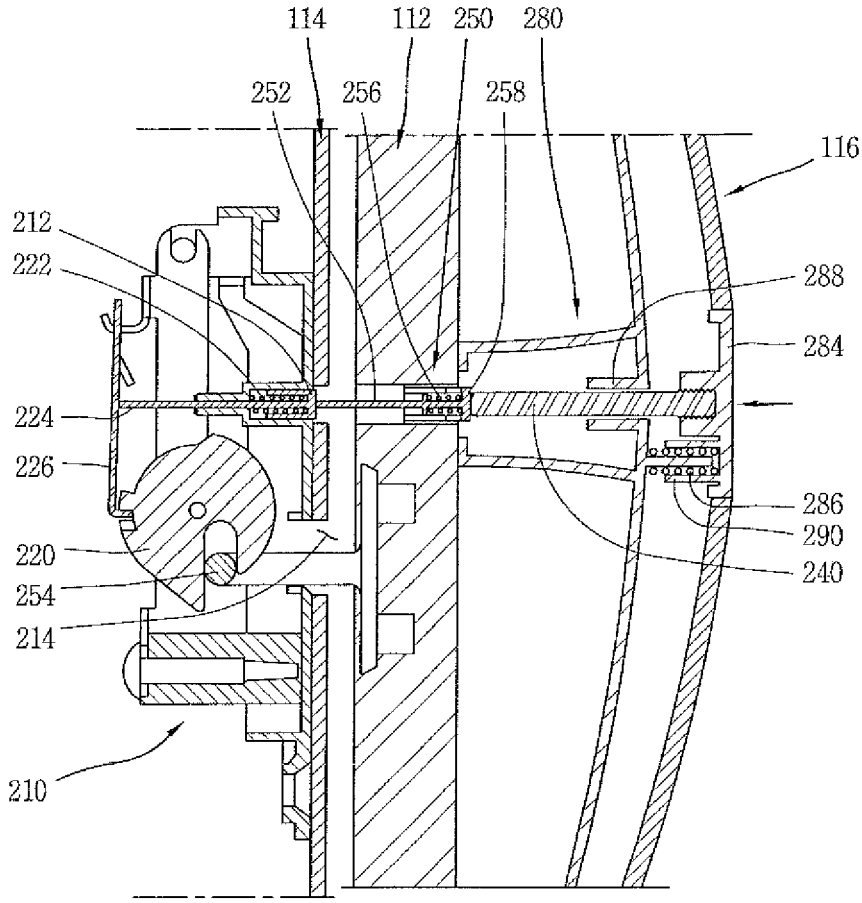
FIG. 12 is a sectional view of a handle further disposed in the second exemplary embodiment shown in FIG. 1.
Figure 13:
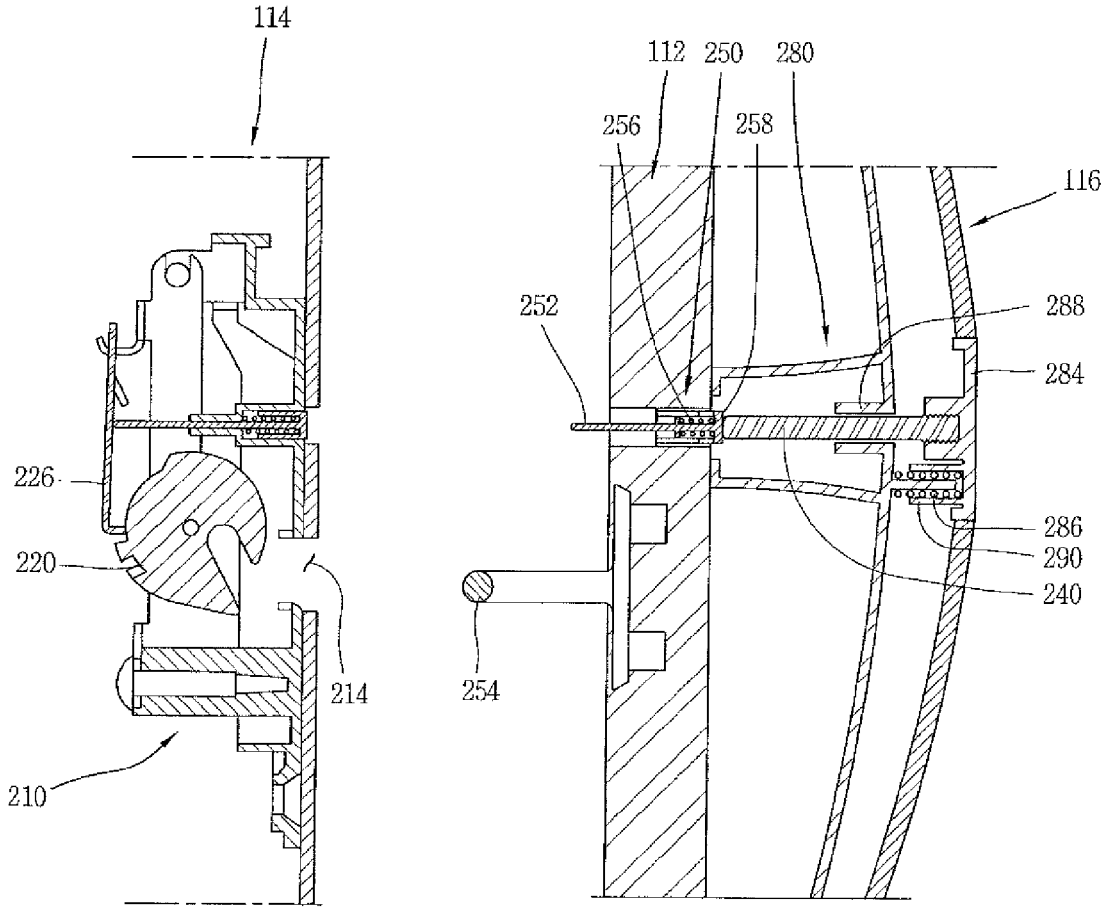
FIG. 13 is a sectional view showing an open state of the second exemplary embodiment shown in FIG. 1.

FIG. 9 is a perspective view showing a second exemplary embodiment of a refrigerator, FIGS. 10 and 11 are sectional views showing a latch device in the second exemplary embodiment shown in FIG. 9, FIG. 12 is a sectional view of a handle further disposed in the second exemplary embodiment shown in FIG. 1, and FIG. 13 is a sectional view showing an open state of the second exemplary embodiment shown in FIG. 1.

Hereinafter, the similar/like components to the first exemplary embodiment will be given of the similar/like reference numerals, and description thereof will be omitted.

A latch device 210 as a coupling unit may be installed at the front surface of the inner door 114 in accordance with the second exemplary embodiment, and the outer door 112 may be provided with a second pressing portion 256 and a locking hook 254 located below the second pressing portion 256 and selectively coupled to the latch device 210. The locking hook 254 may be inserted into a hook insertion hole 214 provided at the latch device 210, and the second pressing portion 256 may be disposed to face a first pressing button 212 provided at the latch device 210.

Hence, when the locking hook 254 is inserted into the hook insertion hole 214 to be coupled to a latch member to be explained later, the outer door 112 may remain closed at the inner door.

Referring to FIGS. 10 and 11, the latch device 210 may include a latch member 220 selectively coupled to the locking hook 254. The outer door 112 may include the locking hook 254 locked at the latch member 220, and the second pressing portion 256 to release the locked state in cooperation with the latch device 210. In addition, referring to FIG. 12, the outer door 112 may include a third pressing portion 280 disposed at the handle 116 to press the second pressing portion 256.

The latch device 210 may include a first button 212 formed through the front surface of the inner door 114, as a through hole, and elastically pressed, a first spring 222 disposed to elastically support the first button 212 and installed in a first pressing installation portion 240 of the inner door 114, a first press pin 224 elastically reciprocating in left and right directions with being fixed into the first button 212, a stopper 226 for restricting the movement of the latch member 220 to prevent the latch member 220 from being unlocked, and a hook insertion hole 214 in which the locking hook 254 is inserted. The stopper 226 may release the locked latch member 220 by elastic pressure applied from the first press pin 224.

The latch member 220 may have a recess formed at its outer circumferential surface and engaged with the stopper 226. Referring to FIG. 10, when the stopper 226 is engaged with the recess, the rotation of the latch member 220 is restricted. However, when the stopper 226 is released out of the recess, the latch member 220 may be free to rotation. Here, the latch member 220 is coupled with an elastic member (not shown), thus to be rotated in a counterclockwise direction based on FIG. 10 when not affected by an external impact. Therefore, when being released from the stopper 226, the latch member 220 may be rotated in the counterclockwise direction such that the locking hook 254 can be released from the latch member 220. Here, the rotation angle, as shown in FIG. 13, may be set to be less than 90°. Accordingly, when the locking hook 254 moves directly to the latch member 220 to push it, the latch member 220 may return to the state of FIG. 10.

The second pressing portion 256 may include a second press pin 252 to elastically press the first button 212, in cooperation with the first press pin 224, to release the locked state, a second button 258 and a second spring 256.

Hereinafter, operations of the above exemplary embodiment will be described with reference to FIGS. 10 and 11. First, as shown in FIG. 10, the outer door 112 is closed with respect to the inner door 114. Here, the outer door is closely adhered onto the front surface of the inner door and the locking hook 254 is inserted into the hook insertion hole 214 formed through the front of the inner door 114.

The latch member 220 may have a U-like cut-off recess (reference numeral not given) recessed into one side thereof. The cut-off recess may be inclined to the right before the door is closed. Thus, in a state that the cut-off recess of the latch member 220 is open toward the hook insertion hole 214, when the locking hook 254 is locked into the cut-off recess to be pushed to the left, the latch member 220 may rotate in a clockwise direction.

The latch member 220 may include a locking portion (reference numeral not given) as a protrusion formed at the right of the cut-off recess, as shown in FIG. 10, for restricting the locking hook 254 in the locked state. The locking hook 254, as shown in FIG. 10, may include a locking hole in which the locking portion of the latch member 220 is inserted to be locked therein. Accordingly, referring to FIG. 10, the latch member 220 rotates in the clockwise direction of being pushed by the locking hook 254, which makes the cut-off recess face a downward longitudinal direction. Thusly, the locking portion of the latch member 220 may be inserted into the locking hole of the locking hook 254, thereby locking the locking hook 254.

Here, for restriction of the rotation of the latch member 220, the stopper 226 may be locked at an outer circumferential surface of the latch member 220, thereby restricting the counterclockwise rotation of the latch member 220. Hence, the locking hook 254 is fixed in the locked state, so the door 112 may remain closed.

When releasing the locked door, as shown in FIG. 11, the second button 258 formed at the second pressing portion 256 of the outer door 112 may be pressed to unlock the outer door 112.

In response to this, the second press pin 252 formed in series with the second button 258 contacts the first button 212 through the outer door 112. When the second button 258 is pressed, the second press pin 252 presses the first button 212 and accordingly the first press pin 224, which is fixed in series with the first button 212, pushes the stopper 226 to the left.

The stopper 226, as aforementioned, restricts the counterclockwise rotation of the latch member 220. The stopper 226 is pushed to the left by the first press pin 224 to be free from the contact with the outer circumferential surface of the latch member 220, which allows the latch member 220 to rotate counterclockwise. The cut-off recess is formed in the inclined direction to the right, so the locking hook 254 locked at the locking portion is released therefrom.

Here, the first button 212 and the second button 258 may elastically reciprocate by virtue of the first spring 222 and the second spring 256, thus they can be back to the original positions after being pressed.

In order to realize the door locking function again, as aforementioned, the outer door 112 itself is pushed tightly onto the inner door 114, whereby the locking hook 254 can be locked by being inserted into the hook insertion hole 214.

Hereinafter, description will be given of a structure of a handle provided at a door of a refrigerator in accordance with a second exemplary embodiment, with reference to FIGS. 12 and 13.

The handle 116 may include a third pressing portion 280 for unlocking the outer door 112 in cooperation with the second pressing portion 256. The handle 116, as shown in FIG. 12, is attached as a separate member onto the outer surface of the outer door 112, so coupling members may be fixedly coupled at ends or a center of the handle 116 by use of coupling bolts.

The third pressing portion 280 may include a third press pin 282 for elastically pressing the second pressing portion 256 to unlock the door, a third button 284 fixed to the third press pin 282 and exposed to the front of the handle 116 for allowing a user to elastically press it, and a third spring 286 elastically supported by the third button 282 to allow elastic reciprocating of the third press pin 282 and the third button 284.

Thus, the third press pin 282 of the third pressing portion 280 may preferably contact the upper surface of the second button 258 to elastically press it.

The handle 116 may include a third press pin guide 288 to guide the third press pin 282 to press the second button 258 when the third press pin 282 elastically reciprocates. The third press pin guide 288, as shown in FIGS. 12 and 13, may allow the third press pin 282 to be fixed to a desired position thereof within the handle 116. Typically, the third press pin guide 288 may be formed in a shape like a long tube such that the third press pin 282 can penetrate therethrough and be fixedly supported by the handle 116.

The third button 284 may include a third spring support portion 290 for supporting the third spring 286 and inducing an elastic operation of the third spring 286. Referring to FIGS. 12 and 13, the third spring supporting portion 290 may preferably be present at a location of the third button 284 slightly spaced apart from a location where the third press pin 282 is formed. The third spring support portion 290 may support a weight separate from the third press pin 282. Hence, it may be formed separately to prevent the danger of mis-operation or the like.

This exemplary embodiment, as shown in FIGS. 12 and 13, shows a structure that as the handle 116 is employed as a separate member and the third button 284 is formed at the central portion of the handle 116. When the third press pin 282 presses the second button 258, the second press pin 252 presses the first button 212 fixed in series with the first press pin 224, thereby releasing the locked state.

For the handle 116, when the press pin and the button are fabricated in an integral form with each other, the press pin becomes long in length, which may cause a structural problem, such as restricting (latching). Thus, they are fabricated independent of each other. Also, since the third pressing portion 280 is formed at the detachable handle 116 of the refrigerator door, it may be easily applied to an existing refrigerator door that only the second button 258 of the second pressing portion 256 is externally exposed without a handle, which may result in improvement of efficiency in management and reduction of fabricating cost.

Accordingly, when the third button 284 of the handle 116 is pressed, the weight of the third button 284 is sequentially transferred as an axial force to the third press pin 282, the second press pin 252 and the first press pin 224. Eventually, the stopper 226 is pushed to the left. Consequently, as aforementioned, the latch member 220 rotates in the counterclockwise direction, thereby being unlocked.

Figure 14:
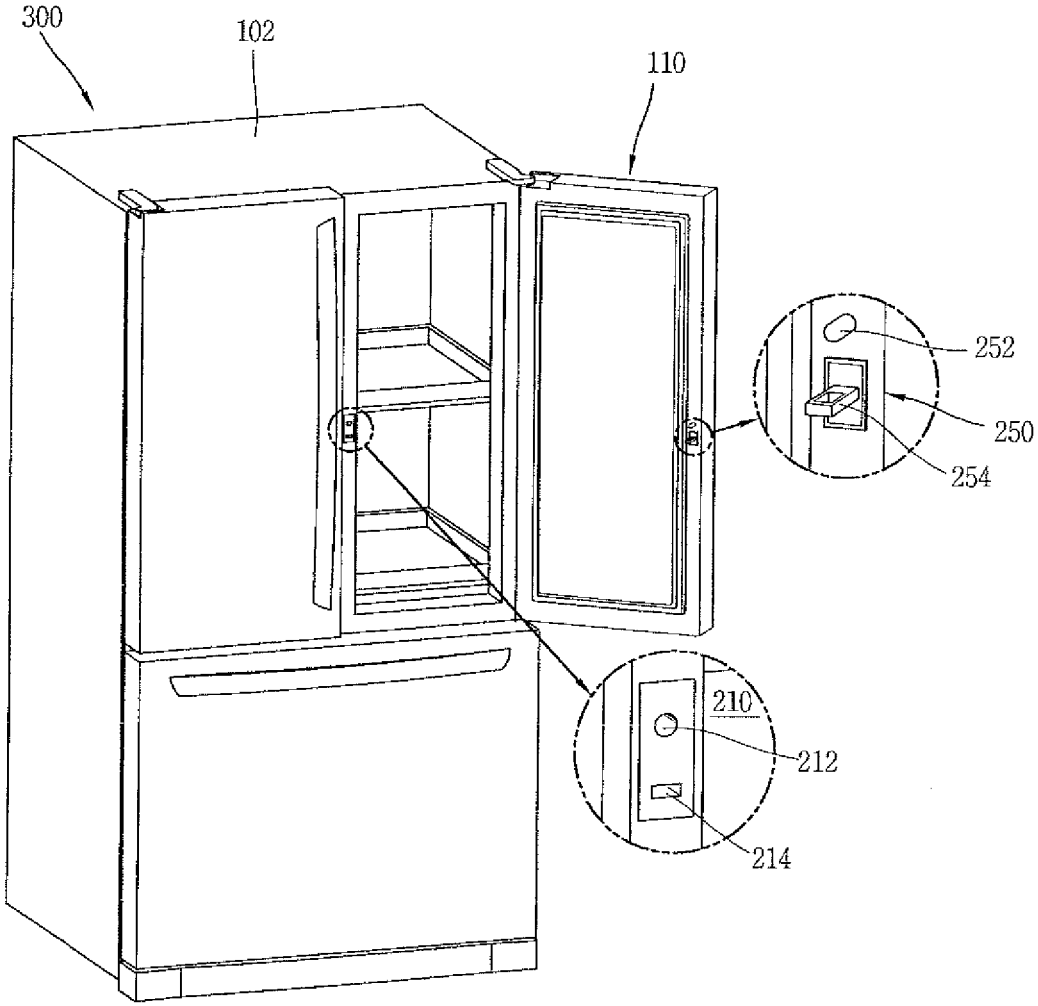
FIG. 14 is a perspective view showing a second exemplary embodiment of a refrigerator.

In the meantime, the exemplary embodiments may not be limited to the illustrated structures or configurations, but applicable to a refrigerator without an inner door. FIG. 14 shows a third exemplary embodiment of a refrigerator without an inner door. The third exemplary embodiment is the same as the exemplary embodiment shown in FIG. 9, excluding that the latch device is formed at a front surface of the cabinet 102 other than the inner door and the second pressing portion 256 is disposed at the first refrigerating chamber door 110.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A refrigerator, comprising:

a cabinet having a first storage area in which a plurality of shelves are vertically arranged;

a first door rotatably coupled to a front surface of the cabinet and configured to open or close at least a portion of the first storage area, the first door including:

a second storage area at a rear surface thereof, and an access opening enabling access to the second storage area;

a second door configured to contact a front surface of the first door to close the access opening, and configured to rotate to open the access opening, wherein a rotating direction of the second door to open the access opening is identical to a rotation direction of the first door to open the first storage area;

a handle provided on a front surface of the second door;

a first hinge connecting an upper part of the first door and an upper part of the cabinet;

a second hinge connecting the first door and the second door;

a locking hook provided to the second door;

a latch device provided to the first door and configured to confine or release the locking hook;

a first pressing portion located at the first door and configured to release the locking hook from the latch device;

a second pressing portion located at the second door and configured to press the first pressing portion; and a third pressing portion located at the handle and configured to press the second pressing portion.

2. The refrigerator according to claim 1, wherein the latch device includes:

a latch member selectively coupled to the locking hook; and a stopper restricting rotation of the latch member.

3. The refrigerator according to claim 2, wherein the first pressing portion includes:

a first button provided on the front surface of the first door;

a first spring elastically supporting the first button; and a first pressing pin that extends from the first button, that passes through the first door, and that is configured to selectively press the stopper based on an elastic force of the first spring.

4. The refrigerator according to claim 3, wherein the second pressing portion includes:

a second button provided on the front surface of the second door;

a second spring elastically supporting the second button; and a second pressing pin that extends from the second button, that passes through the second door, and that is configured to selectively press the first button based on an elastic force of the second spring.

5. The refrigerator according to claim 4, wherein the third pressing portion includes:

a third button provided on a front surface of the handle;

a third spring elastically supporting the third button; and a third pressing pin that extends from the third button, that passes through the handle, and that is configured to selectively press the second button based on an elastic force of the third spring.

6. The refrigerator according to claim 5, wherein the first to third pressing portions are arranged in line.

7. The refrigerator according to claim 5, wherein the third pressing pin is maintained in contact with the second button.

8. The refrigerator according to claim 5, wherein, based on pressing of the third button, the first and second pressing pins are pressed to allow the latch member to rotate in a manner that separates the stopper from the latch member, and wherein the locking hook is released from the latch member based on the rotation of the latch member such that that only the second door is opened by pulling of the handle.

9. The refrigerator according to claim 5, wherein, based on pulling of the handle without the third button being pressed, the first and second doors are opened together.

* * * * *